United States Patent [19]

De Smet

[11] Patent Number: 5,016,458

[45] Date of Patent: May 21, 1991

[54] METHOD AND DEVICE FOR PRESSING SHEET MATERIAL WITH A DEFORMABLE PUNCH UNDER A RAM

[75] Inventor: Gabriel De Smet, Nogent Sur Oise, France

[73] Assignee: Isoform, Puteaux, France

[21] Appl. No.: 458,335

[22] Filed: Dec. 28, 1989

[30] Foreign Application Priority Data

Dec. 30, 1988 [FR] France ..... 88 17524

[51] Int. Cl.[5] ..... B21D 26/02

[52] U.S. Cl. ..... 72/57; 72/63; 72/465; 29/421.1

[58] Field of Search ..... 72/56, 57, 60, 63, 465; 29/421.1

[56] References Cited

U.S. PATENT DOCUMENTS

| | | | |
|---|---|---|---|
| 2,422,883 | 6/1947 | Bruderlin . | |
| 2,507,194 | 5/1950 | Chyba . | |
| 2,719,500 | 10/1955 | Kraybill | 72/57 |
| 2,783,727 | 3/1957 | Hoffman | 72/57 |
| 3,357,218 | 12/1967 | Mitchell | 72/63 |
| 3,533,256 | 10/1970 | Hurek et al. | 72/63 |
| 3,585,829 | 6/1971 | Hurek | 72/63 |
| 4,689,979 | 9/1987 | Otsuka et al. | 72/57 |
| 4,770,015 | 9/1988 | DeSmet | 72/57 |
| 4,833,903 | 5/1989 | DeSmet | 72/57 |

FOREIGN PATENT DOCUMENTS

| | | | |
|---|---|---|---|
| 2590814 | 6/1987 | France | 72/57 |
| 1271-614-A | 7/1985 | U.S.S.R. . | |
| 1041000 | 9/1966 | United Kingdom | 72/63 |

*Primary Examiner*—David Jones

*Attorney, Agent, or Firm*—Fay, Sharpe, Beall, Fagan, Minnich & McKee

[57] ABSTRACT

Method for pressing sheet material, in particular sheet metal, on a press by way of a cushion (12) composed of an elastic material, comprising disposing a sheet blank (20) to be formed on a support whose peripheral part forms a lower blank holder (2) and whose central part constitutes a die (3), applying, under the action of an outer slide, an upper blank holder (9) on the peripheral portion of the sheet blank (20), then applying a punch (11) under the effect of a ram, the method further comprising, in the course of a first step, applying, under the action of the ram, the cushion (12) on the sheet blank (20) for preforming the sheet blank in such manner as to impart thereto a surface area substantially equal to the surface area of the finished part to be obtained, then, in the course of a second step, continuing, under the action of the ram, the descent of the elastic cushion (12) and simultaneously displacing all or a part of the bottom of the die (3) for achieving the final shaping of the part.

16 Claims, 7 Drawing Sheets

METHOD AND DEVICE FOR PRESSING SHEET MATERIAL WITH A DEFORMABLE PUNCH UNDER A RAM

The present invention relates to a method and device for pressing sheet material, in particular large extra-thin sheet metal blanks of utility for example in the automobile industry, and/or comprising complex shapes with a deformable punch under a plunger.

The pressing of parts of large size and complex shapes is generally carried out with double-action presses. These machines mainly comprise a fixed table which receives a die and two independent slides: an outer slide carrying a blank holder and a central slide, termed ram, carrying a punch. First of all, the outer slide and the blank holder descend and maintain a clamping of the sheet blank, then the punch, under the action of the central slide, rapidly descends until it comes into contact with the sheet blank and continues to descend during the pressing stage, and finally the central slide and the outer slide rise substantially at the same time.

This conventional method does not permit the pressing of extra-thin sheets, for example having a thickness of less than 45/100 mm, since the rigidity of the die and punch and the clamping of the sheet by the blank holder create non-homogeneous deformations which result in certain regions in elongations liable to produce an excessive thinning bearing in mind the small initial thickness of the sheet, and in other regions in shrinkages which tend to produce a thickening of the sheet blank resulting in the formation of wrinkles.

Furthermore, in respect of steels having a high elastic limit, this conventional pressing method requires, in order to avoid the formation of wrinkles under the blank holder, the exertion of a very high pressure by the latter on the sheet blank that most machines are unable to provide.

A method, termed "the Guerin method", is also known in which a sheet resting on an elastomeric mass is formed by means of a punch. The punch is forced into the elastomer forming the die and the latter urges the sheet blank against the punch. The function of the elastomer is therefore that of a die. The main drawback of this method is that it consumes considerable energy and, moreover, this method does not avoid the formation of wrinkles. Indeed, the pressure gradients resulting from the deformation of the elastomer decrease as the upper surface of the mass of elastomer is approached, above all in the realization of angular shapes, the sheet blank being insufficiently held at its periphery.

A forming method is also known which employs a fluid under pressure for forming simple shapes of the hemispherical and/or of revolution type. However, this method can only be used for parts having a shape of revolution or an axisymmetrical shape.

There is known from FR-A-2,564,339 and FR-A-2,590,814 a pressing method effected on an elastic cushion. In this method, the sheet blank to be formed is placed on an elastic cushion, an outer slide carrying a blank holder is applied on the peripheral portion of the sheet blank so as to cause the flow of the mass of the elastic cushion and deform the central portion of the sheet blank imparting thereto at the end of the preforming step a surface area substantially equal to the surface area of the finished part to be obtained, then a punch is applied by means of a central slide on the central portion of the sheet blank so as to finally shape the part.

However, this method creates stresses which may be overcome in an original way by the method according to the present invention.

Indeed, there is produced at the moment of the return to the state of equilibrium of the elastic cushion, i.e. at the moment of the rising of the plunger and blank holder, a suction effect of said elastic cushion on the part formed which may result in the collapse of the part, in particular in the case of parts of large sizes. Furthermore, note that the return to the initial state of the elastic cushion occurs from the centre in the direction toward the periphery, which increases the suction effect.

There is also known from U.S. Pat. No. 2,859,719 a pressing method which employs simultaneously a pressing on an elastomer and a pressing under a fluid pressure. The element based on an elastomer disposed on top of the sheet blank is not only constituted by a mass of elastomer but also includes a bladder inflatable by a fluid, which makes it similar to a hydroforming method. Furthermore, this method does not have a first preforming step in which the preformed sheet blank assumes a surface area substantially equal to the surface area of the finished part to be obtained.

An object of the present invention is to provide a novel method which, while it retains the effectiveness and the long life of the cushion of elastic material, permits obtaining pressed parts of medium depth but of large area, such as automobile parts the central portions of which are practically never shapes of revolution but represent non-developable complex shapes, with no problem of suction and incorporating other advantages which will be explained hereinafter.

The invention therefore provides a method for pressing sheet material, in particular metal sheets, on a press by means of a cushion composed of an elastic material, comprising disposing a sheet blank to be formed on a support whose peripheral part forms a lower blank holder and whose central part constitutes a die, applying, under the action of an outer slide, an upper blank holder on the peripheral portion of the sheet blank, then applying a punch under the effect of a ram, said method further comprising, in the course of a first step, applying, under the action of the ram, the elastic cushion forming a deformable punch on the sheet blank so as to effect the preforming of the blank and impart thereto a surface area substantially equal to the surface area of the finished part to be obtained, then, in the course of a second step, continuing, under the action of the ram, the descent of the elastic cushion and simultaneously displacing all or a part of the bottom of the die for producing the final shape of the part.

According to another feature of the invention, during the action of the upper peripheral blank holder on the sheet blank, an edge portion of the sheet blank is flanged in localized regions.

The invention also provides a device for pressing sheet material, in particular blanks of sheet metal, comprising a cushion composed of an elastic material, a support for the sheet blank to be formed, whose peripheral portion forms a lower blank holder and whose central portion constitutes a die, means for preforming the sheet blank and comprising an outer slide carrying an upper sheet holder, and means for finally forming the sheet blank and comprising a ram acting on the punch, wherein the cushion composed of an elastic material is disposed on top of the sheet blank and is connected to the vertically movable punch.

According to other features of the invention:

the elastic cushion has a constant volume and is constituted by a deformable and non-compressible material placed in an envelope, the die has a fixed part and a vertically movable core cooperating with means for controlling the displacement of said core for the purpose of achieving the final shaping of the part;

the die comprises a fixed core and a vertically movable part cooperating with means for controlling the displacement of said movable part for the purpose of achieving the final shaping of the part;

the whole of the die is vertically movable and cooperates with means for controlling the displacement of said die for the purpose of achieving the final shaping of the part.

A better understanding of the invention will be had from the following description which is given solely by way of example with reference to the accompanying drawings, in which.

Figure 1:
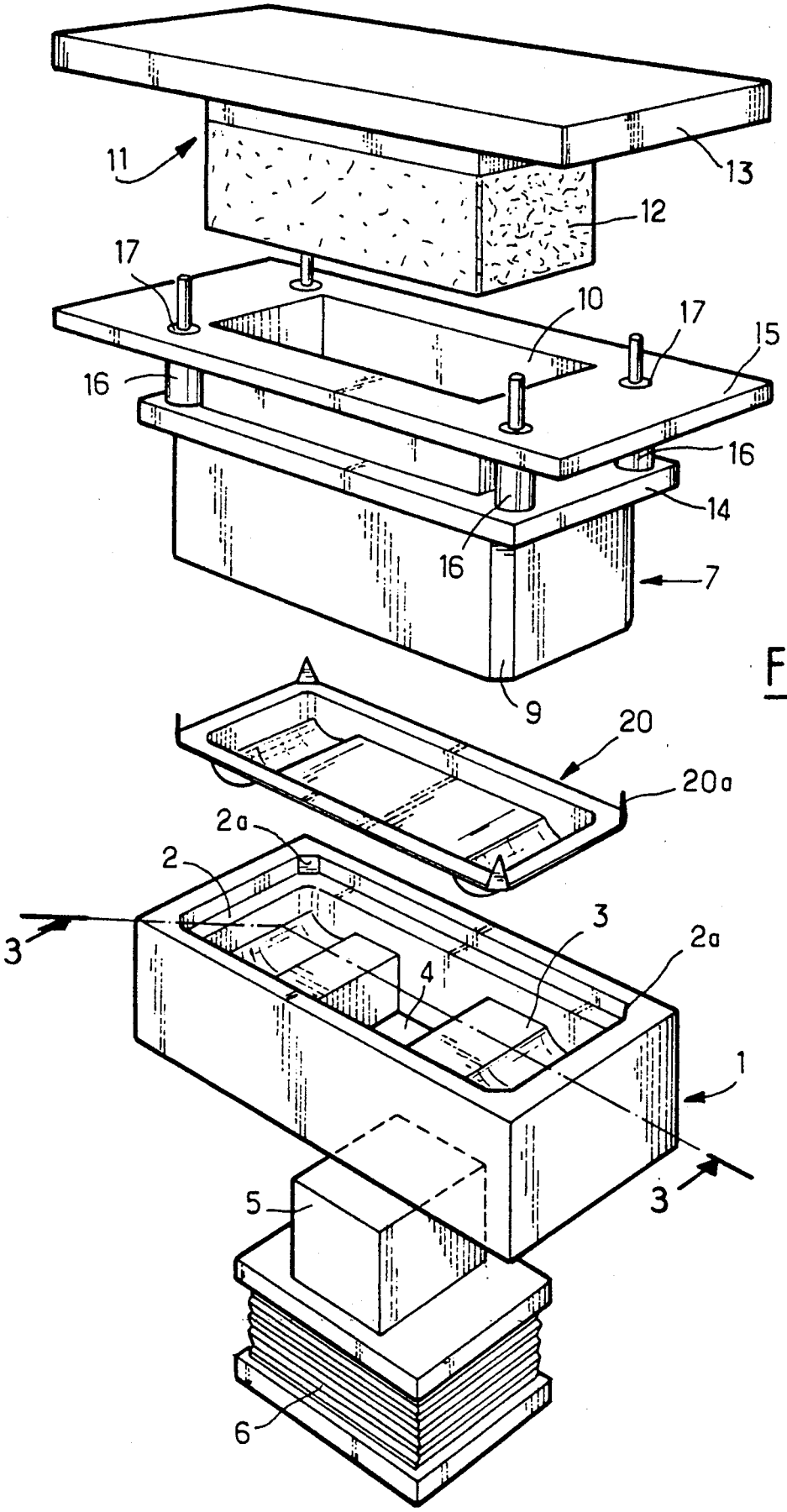
FIG. 1 is an exploded perspective view of the different elements making up the pressing device according to the invention.

The pressing device shown in FIG. 1 comprises a base 1 whose central part constitutes a recess for a die 3 which may be in one piece with the base 1 and comprises in its upper part a die cavity or impression corresponding to the profile of the finished part to be obtained.

The base 1 comprises, on one hand, an inner part forming a blank holder 2 located at a level higher than the impression of the die 3 and, on the other hand, an upper part constituting a region 2*a* for the flanging of the edge portion of the sheet blank 20.

Further, the die 3 comprises a cavity 4 into which penetrates a core 5 sliding in the cavity and having an upper surface which completes the impression of the die 3 for producing the profile of the finished part.

According to the first embodiment shown in FIG. 1, the core 5 is movable and cooperates with means 6 for controlling the displacement of the core which may for example comprise a multiplate brake, a spring, a jack, or any other suitable system.

Above the base 1, the pressing device comprises a body 7 whose lower part constitutes an upper peripheral blank holder 9.

The upper peripheral blank holder 9 has outside dimensions which are less than those employed on the base 1 so that said upper blank holder 9 can penetrate into said base and reach the lower blank holder 2.

The body 7 comprises a well 10 into which a punch 11 extends. This punch 11 comprises a cushion 12 composed of an elastic material and includes in its upper part a plate 13. Furthermore, the body 7 is provided on its periphery with two superimposed flanges 14 and 15 respectively.

The first flange 14 carries jacks 16 respective rods of which extend through respective orifices 17 in the second flange 15 and cooperate with the plate 13 of the punch 11 and constitute a system for raising the punch at the end of the shaping step and possibly controlling the pressure exerted by the upper blank holder 9.

Figure 2:
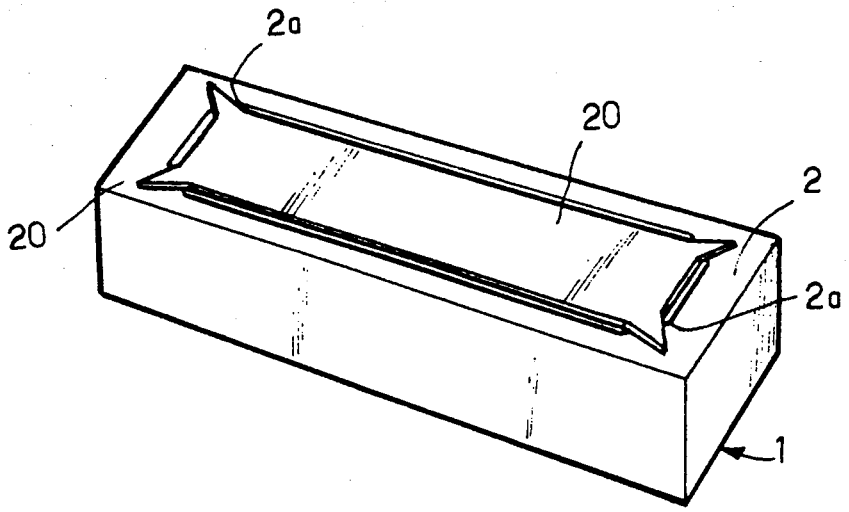
FIG. 2 is a diagrammatic perspective view of the die, showing the positioning of the sheet blank on this die before pressing.

The sheet blank 20 comprises in localized regions cut-away portions forming horns 20*a* which, when the blank is positioned on the upper surface of the base 1, bear on the predetermined regions 2*a* for flanging the edge portion of the blank, as shown in FIG. 2. The flanging of the edge portion is therefore achieved in limited regions of the peripheral edge portion of the sheet blank corresponding to the regions 2*a* of the upper part of the base 1, as will be understood later.

The sheet blank 20 is formed in the following manner.

Figure 3:
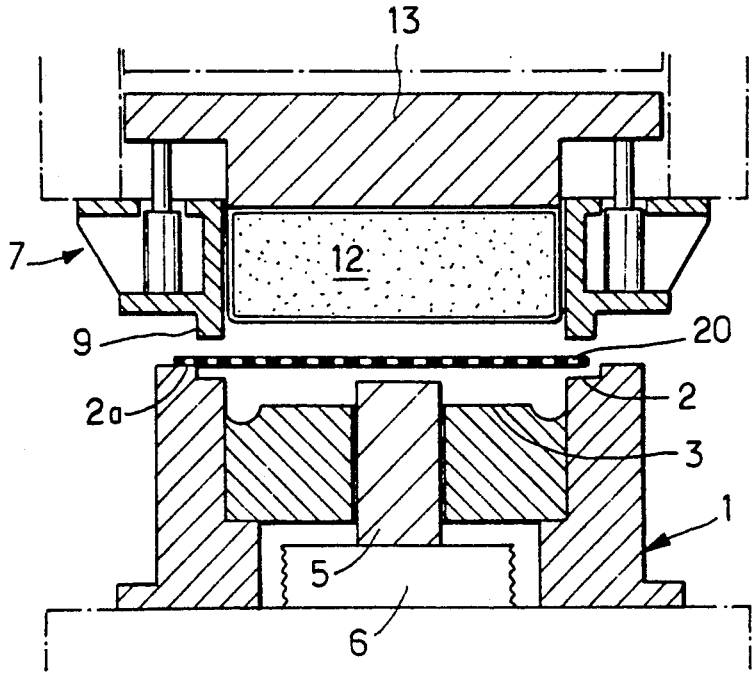
FIGS. 3 to 6 are diagrammatic sectional views taken on line 3—3 of FIG. 1 in the course of the successive steps for forming a part.

First of all, the sheet blank 20 is placed on the upper surface of the base 1, this blank resting solely by the horns 20*a* on the regions 2*a* (FIG. 3). The core 5 projects above the impression of the die 3 and the means 6 for controlling the displacement of the core are locked by a suitable device (not shown).

Figure 4:
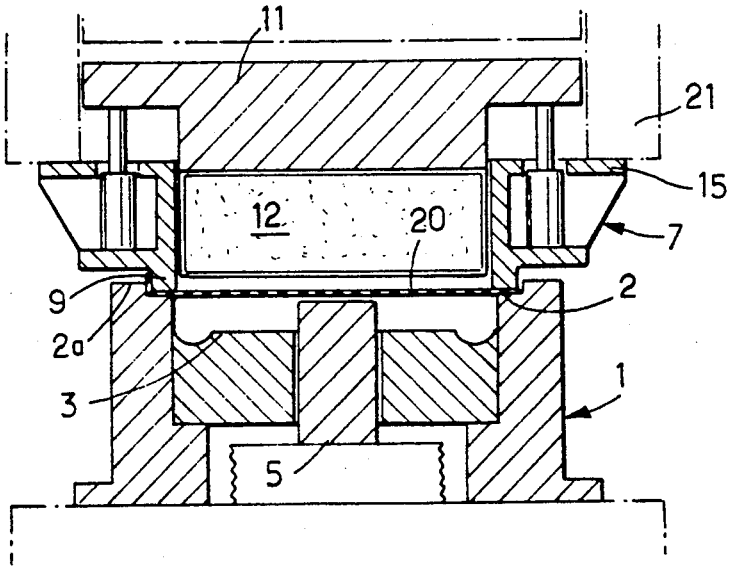

In a first stage, an outer slide 21 of the press (FIG. 4) carrying the body 7 by the flange 15, gradually descends so that the upper blank holder 9 produces, in the regions where the sheet blank 20 bears against the regions 2*a*, the flanging of the edge portion of the sheet blank which is bent.

Consequently, in the course of this first step, the localized regions of the peripheral portion of the sheet blank 20, which would be subjected to high shrinkage in conditions other than those of the present invention, are maintained between the predetermined regions 2*a* and the blank holder 9 so as to produce in these regions the flanging of the edge portion of the sheet blank, whereby it is possible to retain the metal to be shrunk.

Thereafter, a ram 22 of the press comes into contact with the plate 13 of the punch 11 and causes the descent of the elastic cushion 12 whose working surface comes into contact with the sheet blank 20.

Figure 5:
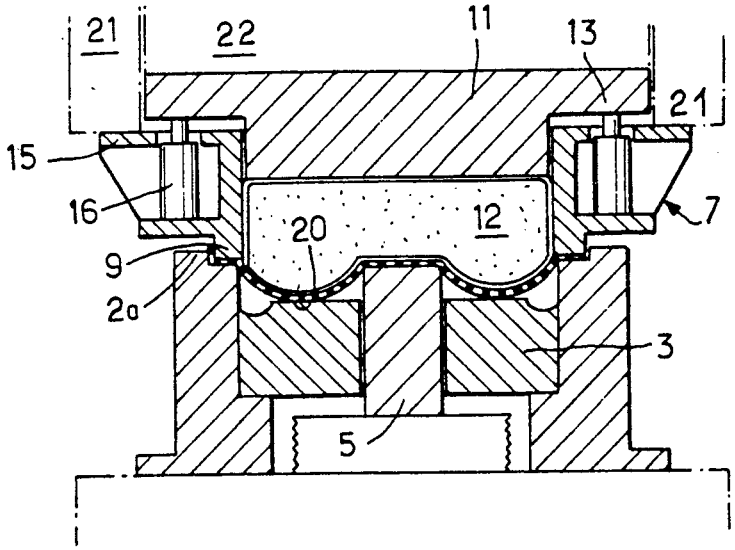

In the course of this descent, as the core 5 is projecting (FIG. 5), the elastic cushion 12 is compressed and, under the effect of this compression action, causes the deformation of the sheet blank 20 in such manner as to produce the preforming of the blank and impart thereto a surface area substantially equal to that of the final part to be obtained.

Figure 6:
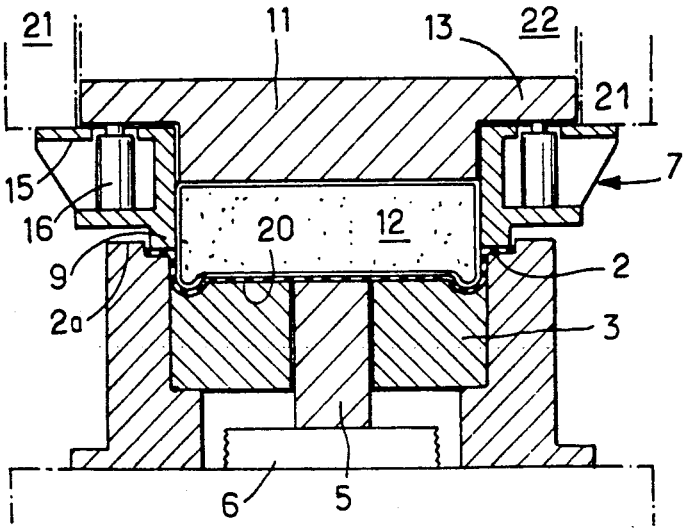
Figure 7:
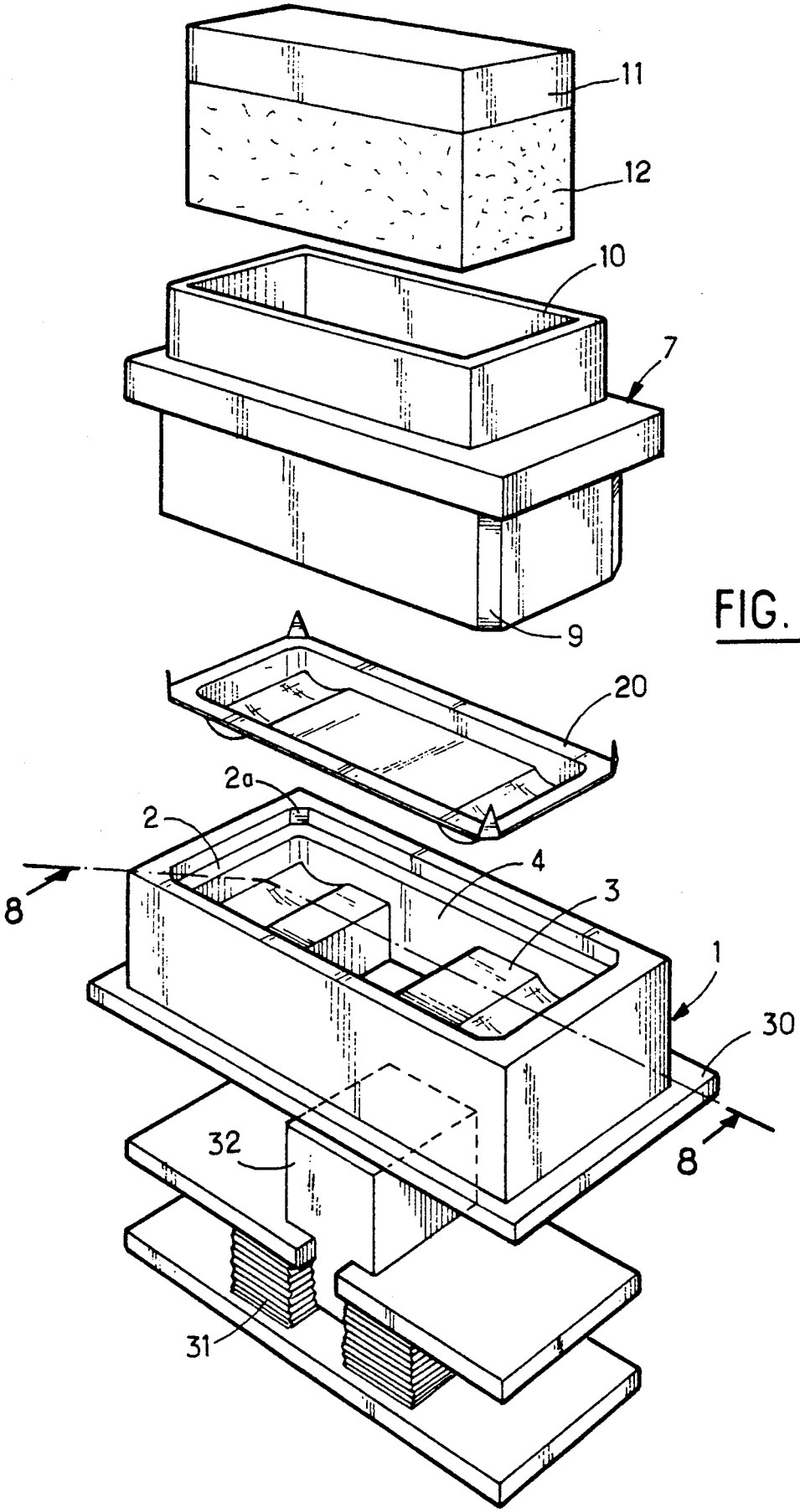
FIG. 7 is an exploded perspective view of a first variant of the pressing device according to the invention.
Figure 8:
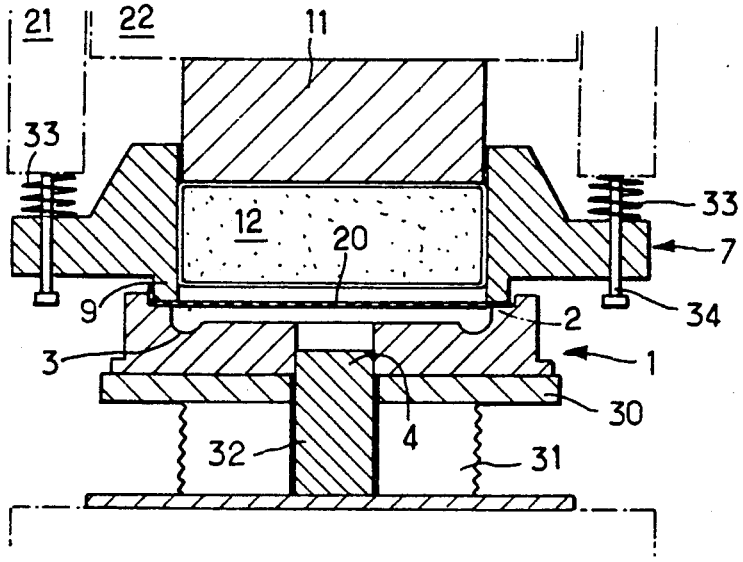
FIGS. 8 to 10 are diagrammatic sectional views taken on line 8—8 of FIG. 7, in the course of the successive steps for forming a part.
Figure 9:
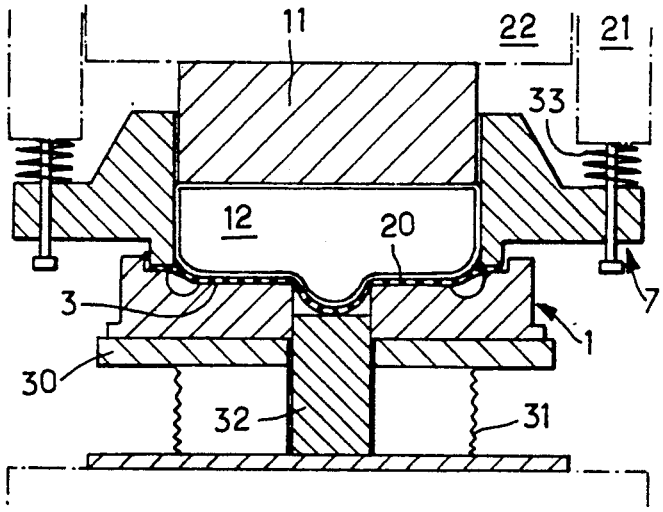
Figure 10:
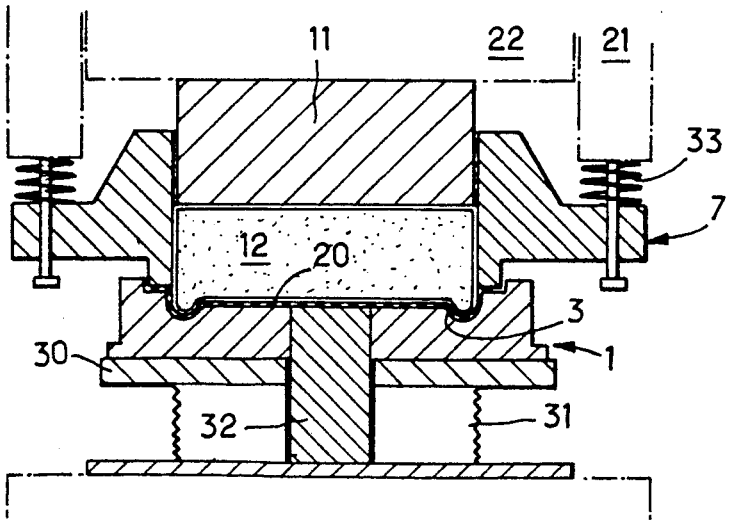

FIG. 6 shows the step for finally shaping the part. The ram 22 descends to its lower position and produces, by means of the electric cushion 12, the final forming of the part which had been preformed in the course of the first part of the descent.

Simultaneously with the descent of the central ram 22 and the punch 11, the means 6 are unlocked so that the movable core 5 is so retracted as to free the developed surfaces of the sheet necessary for the shaping of the finished part.

The compression stresses due to the bearing of the sheet blank 20 against the die 3 brought about by the elastic cushion 12 are converted by the action of said elastic cushion into tensile stresses exerted on the whole of the surface of the sheet blank and result in the displacement of the blank throughout the available volume.

During the descent of the elastic cushion, in the course of the preforming and shaping steps, the edge portions of the sheet blank 20 are held as they slide between the lower blank holder 2 and the upper blank holder 9, and the height of the flanged edge portions of the blank in the localized regions 2*a* decreases.

Moreover, in the course of these steps, the plate 13 of the punch 11 compresses the jacks 16, which also has for effect to regulate the force exerted by the upper blank holder 9 on the peripheral edge portion of the sheet blank 20.

The step for releasing the formed part is carried out first of all by the raising of the ram 22, which releases the punch 11. Under the effect of the jacks 16, the punch 11 rises and carries the elastic cushion 12 along therewith. The elastic cushion 12 is moved away from the formed part in the direction from the periphery toward the centre, so that air enters between the formed part and the outer surface of the cushion and thereby avoids suction effects.

Thereafter, the outer slide 21 rises and carries the body 7 along therewith and finally releases the formed part which may have a shape such as that shown in FIG. 1.

According to a variant illustrated in FIGS. 7 to 10, the base 1 carrying the die 3 is vertically movable and, for this purpose, bears against a sole plate 30 which cooperates with means 31 for controlling the displacement of the base, for example constituted by a multi-plate brake, a spring, a jack or any other suitable system.

As in the foregoing variant, the die 3 comprises a cavity 4 into which extends a core 32 whose upper surface completes the impression of the die 3 for producing the finished part. In this variant, the core 32 is fixed.

The descent and the control of the force exerted by the body 7 under the action of the outer slide 21 is effected by means of springs 33 guided by pillars 34 interposed between the outer slide and the body.

The operations for flanging the peripheral edge portion of the sheet blank in localized regions (FIG. 8) and preforming the blank (FIG. 9) are carried out in a manner identical to that of the foregoing variant, by successive descents of the upper blank holder 9 and the punch 11, the means for controlling the displacement of the base 1 being locked.

On the other hand, simultaneously with the shaping operation (FIG. 10), the means 31 for controlling the displacement of the base 1 are unlocked so as to free the developed surfaces of the sheet by descent of the die 3 during this shaping operation.

Figure 11:
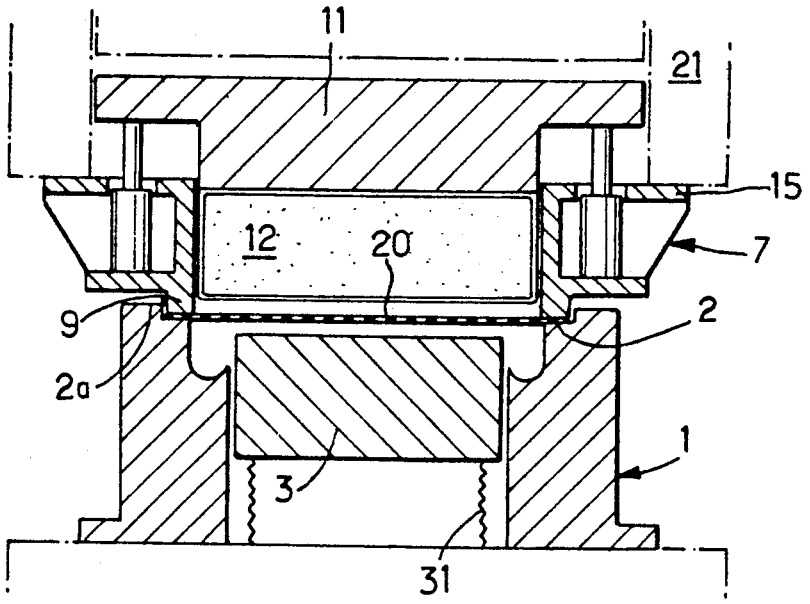
FIG. 11 is a sectional view of a second variant of the pressing device according to the invention.

In a second variant illustrated in FIG. 11, the base 1 is fixed and it is the whole of the die 3 which is vertically movable. The die 3 cooperates with means 31 for controlling the displacement of the die, for example constituted by a multi-plate brake, a spring, a jack or any other suitable system. The part is formed in a manner identical to that of the foregoing variants.

Figure 12:
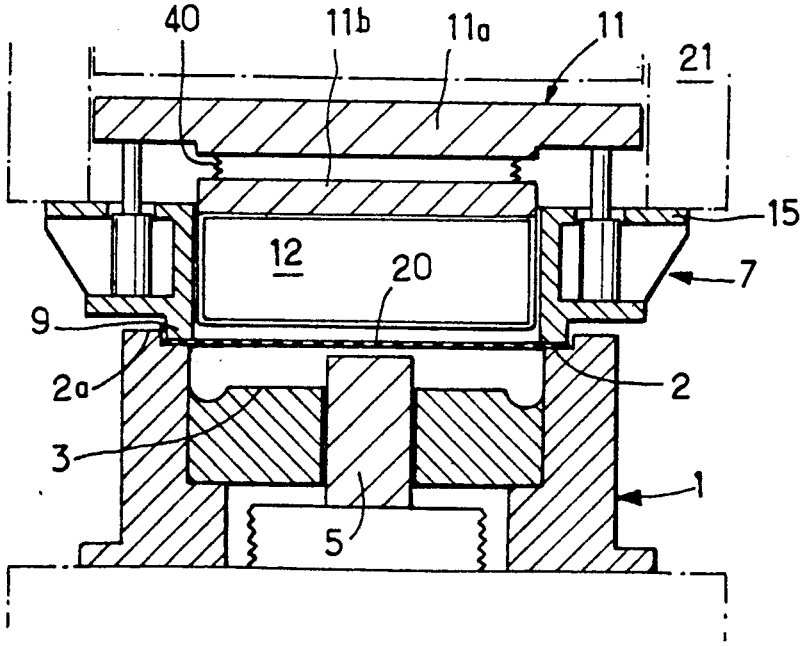
FIG. 12 is a sectional view of a third variant of the pressing device according to the invention.

In a further variant illustrated in FIG. 12, the pressing device comprises means for absorbing the excess volume of the elastic cushion 12 relative to that determined by the surface area of the finished part to be obtained. Indeed, in the course of the preforming step, the descent of the elastic cushion 12 deforms the central portion of the sheet blank and imparts thereto, at the end of the preforming step, a surface area substantially equal to the surface area of the finished part to be obtained. Continuing the descent of the elastic cushion 12 for finally shaping the sheet blank results in an increase in pressure in the cushion and, depending on the part to be produced, possibly a difference in the volume of the cushion between the preforming step and the final shaping step.

For this purpose, the punch 11 (FIG. 12) comprises an upper part 11*a* and a lower part 11*b* between which are interposed springs 40 or any other like system. These springs 40 are compressed above a certain pressure for absorbing the excess volume of the elastic cushion.

Means for absorbing the excess volume of the elastic cushion may also be disposed in the vicinity of the cushion, for example in the lateral walls of the body 7.

Figure 13:
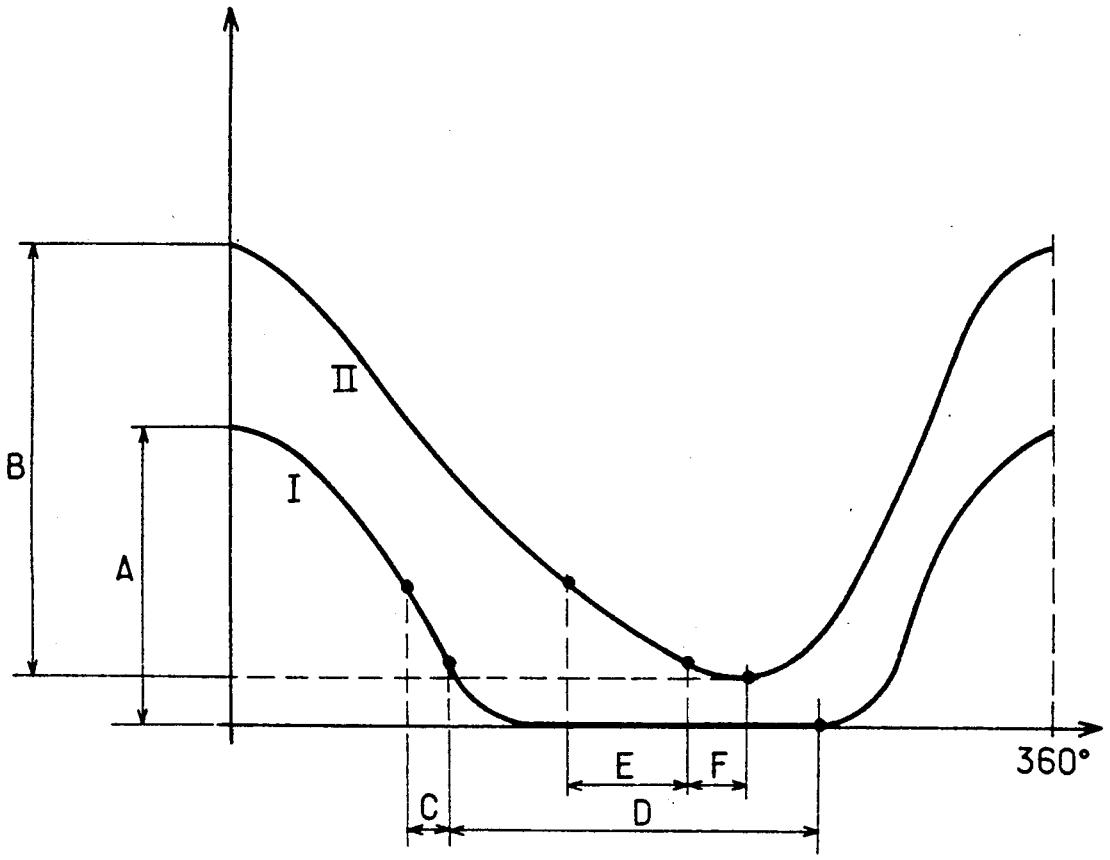
FIG. 13 is a diagram showing a cycle of the device according to the invention during the preforming and the shaping of the part.

In the diagram shown in FIG. 13, the curve I represents the cycle of the outer slide 21 and the curve II the cycle of the ram 22. The outer slide 21 travels through a distance A and the ram 22 through a distance B.

In this diagram, there are represented for each cycle, at C the flanging of the edge portion of the sheet blank in localized regions, at D the holding of the sheet blank at D, the holding of the peripheral edge portion of the sheet blank, at E the preforming operation, and at F the operation for finally shaping the part.

The combination of the flanging of the edge portion in localized regions and the use of the elastic cushion permits obtaining parts of complex non-developable shapes with thin sheets having a low deformation capacity.

The elastic cushion has a constant volume and may be constituted by a deformable and non-compressible material which may be placed in an envelope. This material may be an elastomer or any other product satisfying these conditions.

Although the description was made with reference to the forming of sheet blanks, i.e. thin, usually metal sheets, it must however be understood that the scope of the method according to the invention is in no way intended to be limited to this application. The method according to the invention may be carried out with thin sheets or plates of in particular plastics material.

Thus, in the present description, the term "sheet" must be given the general meaning of a thin sheet of material without limiting the scope of the invention to metal products.

An advantage of the method and device of the present invention resides in the increase, for a given double-action press, in the possible dimensions of the finished pressed part, as compared to the pressing method on an elastic cushion disclosed in FR-A-2,564,339 and FR-A-2,590,814.

It may also be mentioned that the volume of the elastic cushion is smaller than in the aforementioned methods.

Moreover, the spatial presentation of the finished part is similar to that met with in conventional pressing and permits a mechanization of the subsequent operations requiring no change in the equipment.

I claim:

1. Method for pressing a blank of sheet metal, on a press by means of a cushion composed of an elastic material, said method comprising:

disposing a sheet blank to be formed on a support having a peripheral part constituting a fixed lower blank holder and a central part constituting a die, said die comprising a fixed part and a vertically movable part, applying, under the action of an outer slide, an upper blank holder on a peripheral portion of the sheet blank so as to grip the peripheral portion of the sheet blank between the upper blank holder and the lower blank holder, said method further comprising, applying, under the action of a ram, the elastic cushion which constitutes a deformable punch, in a downward direction on the sheet blank toward the die so as to effect a preforming of the sheet blank in such manner as to impart thereto a surface area which is substantially equal to a surface area of the finished part to be obtained, continuing, under the action of the ram, the descent of the elastic cushion and simultaneously displacing said vertically movable part of the die in a direction opposite the punch for finally shaping the part to be obtained.

2. A device for pressing a blank of sheet metal, comprising:

a cushion comprising an elastic material, a support for the sheet blank to be formed, said support having a peripheral part constituting a rigid lower blank holder and a central part constituting a die, said die comprising a vertically movable part, and means cooperative with the vertically movable part for controlling a displacement of the vertically movable part, means for preforming the sheet blank comprising an outer slide mounted above and opposed to said support and a rigid upper blank holder located on the means for finally forming the sheet blank comprising a vertically movable punch located within said outer slide, a ram located within said outer slide for actuating said punch, said cushion being connected to the vertically movable punch for performing said final forming of the sheet blank.

3. A device according to claim 2, wherein the elastic cushion has a constant volume and is composed of a deformable and non-compressible material, and an envelope surrounds the cushion.

4. A device according to claim 2, comprising means for controlling a gripping action of the upper blank holder on the peripheral region of the sheet blank.

5. A device according to claim 2, comprising means for absorbing excess volume of the elastic cushion relative to the volume determined by the surface area of the final part to be obtained.

6. A device according to claim 5, wherein the means for absorbing excess volume of the elastic cushion are disposed in the punch.

7. A device according to claim 5, wherein the means for absorbing excess volume of the elastic cushion are disposed in the vicinity of said elastic cushion.

8. A device according to claim 2, wherein the vertically movable part comprises a core disposed in a cavity formed in the die, the core having an upper surface which completes the impression of the die.

9. A device according to claim 2, wherein the vertically movable part comprises the part of the die disposed around a fixed core having an upper surface which completes the impression of the die.

10. A device according to claim 2 wherein the vertically movable part comprises the whole of the die.

11. A device according to claim 2, wherein the whole of the die is vertically movable and the means cooperative with the movable die for controlling the displacement of the movable die also aids in the final shaping of the part to be obtained.

12. A device for pressing a sheet material blank, comprising:

an elastic material cushion;

a movable punch to which said cushion is secured a ram actuating said punch;

a support for the sheet blank, said support comprising:

a peripheral section constituting a first rigid blank holder, a central section constituting a die, said die comprising:

a fixed part, a rigid movable part, and a means for controlling a displacement of said rigid movable part;

a second rigid blank holder which encircles said punch cooperates with said first rigid blank holder so as to grip a portion of the sheet material blank.

13. The device of claim 12 further comprising a means for controlling a gripping action of said first and second rigid blank holders.

14. The device of claim 12 further comprising a means for absorbing an excess volume of the elastic cushion relative to the volume determined by the surface area of a final part pressed from the sheet material blank.

15. The device of claim 12 wherein said die fixed part comprises a side portion of said die and said rigid movable part comprises a central portion of said die.

16. The device of claim 12 wherein said die fixed part comprises a central portion of said die and said rigid movable part comprises a side portion of said die.

* * * * *